United States Patent [19]

Masai et al.

[11] Patent Number: 4,807,541

[45] Date of Patent: Feb. 28, 1989

[54] APPARATUS FOR LOW CONCENTRATION NOX COMBUSTION

[75] Inventors: Tadahisa Masai; Shigeki Morita; Shigeto Nakashita, all of Kure, Japan

[73] Assignee: Babcock-Hitachi Kabushiki Kaisha, Tokyo, Japan

[21] Appl. No.: 159,214

[22] Filed: Feb. 23, 1988

[30] Foreign Application Priority Data

Feb. 27, 1987 [JP] Japan ..... 62-44728

[51] Int. Cl.[4] ..... F23C 1/10; F23C 1/12

[52] U.S. Cl. ..... 110/262; 110/263; 110/264; 431/284

[58] Field of Search ..... 110/260, 261, 262, 263, 110/264, 347; 431/284, 285

[56] References Cited

U.S. PATENT DOCUMENTS 3,217,779 11/1965 Reed et al. ..... 431/285

3,256,842 6/1966 Vigneron et al. ..... 431/284 X 4,734,028 3/1988 Music ..... 110/261 X

*Primary Examiner*—Edward G. Favors

*Attorney, Agent, or Firm*—Fay, Sharpe, Beall, Fagan, Minnich & McKee

[57] ABSTRACT

A combustion apparatus for low concentration NOx for burning gas, oil and coal along the same axis, having overcome the drawbacks of the prior art, without hindering the whirling of the air and also having prevented clogging of the nozzle and combustion vibration is provided, which apparatus is provided with a means for carrying pulverized coal by a primary air, a means for feeding a gas fuel through a gas nozzle, a means for separating combustion air into a secondary air and a tertiary air and feeding these airs, and a means for feeding and spraying an oil, and which apparatus is characterized by providing an annular space part between the flow paths of the secondary air and the tertiary air; and also arranging the gas nozzle penetrating through the annular space part in a movable manner in the axial direction.

13 Claims, 2 Drawing Sheets

APPARATUS FOR LOW CONCENTRATION NOX COMBUSTION

BACKGROUND OF THE INVENTION

1. Field of the Invention

This invention relates to an apparatus for low concentration NOx (nitrogen oxides) combustion. More particularly it relates to a combustion apparatus such as boiler suitable for burning gas, oil and coal fed along the same axis and thereby reducing the amount of NOx contained in an exhaust gas.

2. Description of the Related Art

A burner for low concentration NOx combustion capable of burning oil and coal fed along the same axis is known, for example as disclosed in U.S. Pat. No. 4,545,307 or its corresponding Japanese patent application laid-open No. Sho 60-78207/1985, but a low $NO_x$ burner capable of burning three kinds of fuels, that is, gas, oil and coal along the same axis has not been known.

The reason is that in the case of such a burner for burning gas, oil and coal along the same axis, since a gas-feeding pipe is provided inside the whirling path of a tertiary air, its flow resistance is so high that it is impossible to afford an intense whirling to the tertiary air. Particularly in the case of a combustion system for low concentration NOx combustion, wherein denitration reaction is carried out within a flame, since such a tense whirling of a tertiary air is one of the requirements. Therefor, it has been impossible to achieve an adequate low concentration NOx combustion.

Another reason is that when coal is burnt, there is a danger of clogging due to ash adhesion or burnout of gas nozzle. Further, in the case of coal combustion boilers, since the depth of the furnace is usually large, a primary resonance frequency in the length direction of the furnace is so low that a combustion vibration is liable to occur.

As described above, a first problem of the prior art resides in that the whirling of the combustion air is hindered due to the gas-feeding pipe whereby it is impossible to afford the intense whirling and it is also impossible to achieve combustion for low concentration NOx making use of denitration reaction in the flame. A second problem of the prior art resides in that when coal alone is burnt, burnout of the gas nozzle or clogging of the gas nozzle hole due to coal ash occurs. Further, a third problem resides in that since coal is a difficultly combustible fuel, it is necessary to design the furnace so as to afford a large volume thereto; hence the depth of the furnace is necessarily so large that the resonance frequency of the primary mode lowers whereby the combustion vibration is liable to be induced at the time of gas combustion.

SUMMARY OF THE INVENTION

The object of the present invention is to provide a combustion apparatus for low concentration NOx combustion, for burning at least one fuel of gas, oil and coal along the same axis, having overcome the drawbacks of the prior art, without hindering the whirling of the combustion air and also having prevented clogging of the nozzle and combustion vibration.

The present invention resides in an apparatus for low concentration NOx combustion which comprises;

a pulverized coal-feeding pipe (pulverized coal pipe) inserted into a burner throat on the lateral wall of a combustion furnace and for feeding pulverized coal together with air into the combustion furnace;

a means for feeding pulverized coal and air into the pulverized coal pipe;

an auxiliary fuel-feeding pipe inserted into the pulverized coal pipe and a nozzle provided at the tip end of said pipe;

a secondary air passageway formed between the pulverized coal pipe and a secondary air-feeding pipe, said secondary air-feeding pipe being concentric with the pulverized coal pipe and provided on the outer peripheral side of the pulverized coal pipe;

a tertiary air passageway formed on the outer peripheral side of the secondary air-feeding pipe;

a means for feeding air or an oxygen-containing gas into said secondary air passageway and that into said tertiary air passageway;

a flame-retaining means provided about the exit of said pulverized coal pipe;

a means for feeding oil into the oil-feeding pipe;

a annular space part provided on the inner peripherical side of the secondary air-feeding pipe;

gas feeding pipes inserted in said annular space part movably in the axial direction thereof, the tip end of the gas-feeding pipe being provided with a gas nozzle;

a means for feeding gas into said gas-feeding pipe.

DETAILED DESCRIPTION OF PREFERRED EMBODIMENTS

Figure 1:
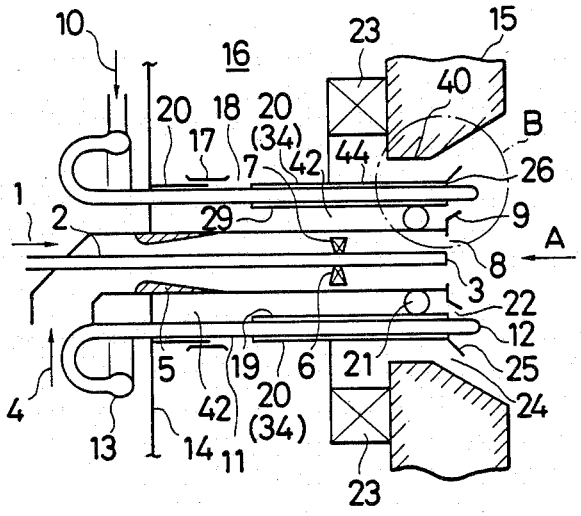
FIG. 1 shows a cross-sectional view illustrating an embodiment of the combustion apparatus according to the present invention.

First important feature of the present invention comprises forming an annular space part where gas-feeding pipes are inserted, which is typically constituted by a secondary inner sleeve, a secondary outer sleeve and annular end plates provided at the both ends of said sleeves. The secondary outer sleeve may be common with a part of the secondary air-feeding pipe. The annular end plates normally have a plurality of holes arranged at equal intervals, through which the gas-feeding pipes are penetrated. With the provision of the above annular space part, it is possible to completely separate and secure the secondary and tertiary air passageways and thereby afford an intense whirling. Further, by placing the gas feeding pipes in said space part, no bad effect upon the whirling of the secondary air and the tertiary air and no flow resistance of air due to placement of the gas-feeding pipes occur.

Second important feature of the present invention is that an annular end plate is provided at the tip ends of the secondary inner sleeve and the secondary outer sleeve so as to connect these sleeves, whereby the ejecting port of the secondary air is partitioned from that of the tertiary air port to make it possible to increase the whirling intensity of the tertiary air and at the same time, reinforce the reducing flame in the combustion zone due to the primary air.

Further, third important feature of the present invention is that in the case coal alone is burnt, for example, in order to prevent burn out or clogging of the gas nozzle due to ash, the gas feeding pipe is drawn out by a definite distance and the gas nozzle thereof is cooled by a cooling air passing through the secondary inner and outer sleeves. The gas feeding pipe is arranged so that it may penetrate through said annular space and said annular end plates, in a movable manner in the axial direction thereof. The distance to be drawn out can be determined so that the gas nozzle or the front part of the gas-feeding pipe is not projected from the hole of said annular end plate. The gas-feeding pipe may be drawn out completely from said annular spaces, if it is unnecessary. By drawing out the gas-feeding pipe by a definit distance, it is possible to relieve a radiant heat from flame, and further by cooling the pipe by a portion of the secondary air, it is possible to protect the gas nozzle from the heat.

Next, the present invention will be described in more detail referring to the drawings.

FIG. 1 shows a cross-sectional view of a burner by which three kinds of fuels, that is gas, oil and coal.

This apparatus is composed of a pulverized coal pipe 6 inserted into a burner throat 40 on the lateral wall of a combustion furnace; an oil-feeding pipe 2 provided with an oil spray nozzle 3 at the tip end thereof, and inserted into said coal pipe 6; a secondary air-feeding pipe 20 provided in the form of double tube so as to form a secondary air passageway on the outer periphery of the pulverized coal pipe 6; a tertiary air passageway provided between the secondary air-feeding pipe 20 and the burner throat 40; a secondary air passageway formed between the pulverized coal pipe 6 and a secondary air-feeding pipe 20, said secondary air-feeding pipe being concentric with the pulverized coal pipe and provided on the outer peripheral side of the pulverized coal pipe; a tertiary air passageway formed on the outer peripheral side of the secondary air-feeding pipe 20; a flame-retaining plate 9 provided at the tip end of said pulverized coal pipe 6 and encircling said pipe; an annular space part 44 provided on the inner peripherical side of the secondary air-feeding pipe 20; said annular space 44 being surrounded by a secondary inner sleeve 19, a secondary outer sleeve 34 and annular end plates 26 provided at the both ends of said sleeves to form said annular space part, said annular end plates 26 having a plurality of holes through which said gas-feeding pipes 11 are penetrated; gas-feeding pipes 11 inserted in said annular space part in a movable manner in the axial direction thereof, the tip end of the gas-feeding pipe 11 being provided with a gas nozzle 12. The fundamental structure and arrangement of the pulverized coal pipe 11 having a flame-retaining plate 9, and a secondary air-feeding pipe 20 may be the same as those of U.S. Pat. No. 4,545,307.

In the above constitution of the burner, oil fuel is first fed through oil-feeding pipe 2, sprayed at spray nozzle 3 and ejected into the inside of the furnance. There are two spray methods, one is a pressurized spraying and another is a two-fluid spraying, and either may be employed in the present invention. Although the oil-feeding pipe 2 and nozzle 3 is provided mainly for starting or igniting the burner, when gas fuel is used as auxiliary fuel for starting the burner, they may be replaced by a gas-feeding pipe and a gas nozzle. On the other hand, coal after pulverized by a mill (the mixture 4 of primary air and pulverized coal) is carried by a primary air through a pulverized coal 5 feeding pipe (abbreviated to coal pipe) 6. The pulverized coal carried by the primary air is accelerated and then decelerated by ventury 5 which is mounted on the inner wall of the coal pipe 6, being given a weak whirling by swirler 7, then fed into the inside of the furnace through an ejection port 8 and burnt therein. A flame-retaining plate (or a bluff body) 9 having a L-letter form cross-section is provided at the ejection port 8 of the coal pipe 6. The bluff body disclosed in U.S. Pat. No. 4,545,307 is preferably used. The flame-retaining plate 9 has a L-letter form cross-section one side of which is formed nearly perpendicularly to the axial direction of the pulverized coal pipe 6 and the other side thereof is formed either in parallel to the axial direction of the pulverized coal pipe 6 toward the combustion furnace or at such an angle that the side is enlarged in the radial direction.

Fine coal particles ejected from the ejection port 8 are then carried by eddy flow generated at the downstream side of the flame-retaining plate 9 to form a stabilized flame there. Air is fed by a forced ventilator into wind box 16 constituted by wind box wall 14 and boiler wall 15. A portion of this air flows in the box through secondary air intake 18 the opening of which is controlled by slide damper 17, passes through an annular passageway between the pulverized coal pipe 6 and the secondary inner sleeve 19 given a whirling by secondary vane 21, and fed through secondary ejection port 22 into the inside of the furnace. The remainder of the air forms a whirling stream by tertiary air resistor 23 which is provided at the rear side of the boiler wall 15 and is fed through tertiary ejection port 24 into the inside of the furnace. On the other hand, gas fuel 10 is fed to gas manifold 13, passes therefrom through a plurality of gas-feeding pipes 11 and is fed through gas nozzles 12 into the inside of the furnace. The gas-feeding pipe 11 having gas nozzle 12 is constructed so as to be movable by a definite distance in the direction of burner axis. They are supported loosely by the holes in the annular end plates 26. Secondary inner sleeve 19 is provided with one or a plurality of cooling air holes 29 in order to cool the gas nozzles 12 and prevent ash adhesion thereon. At the tip end of a secondary outer sleeve 34 which is common with a part the secondary air-feeding pipe 20, a tertiary guide sleeve 25 is provided as shown in the figure in order to regulate the secondary air flow and as a flame-retaining plate at the time of gas combustion.

Figure 2:
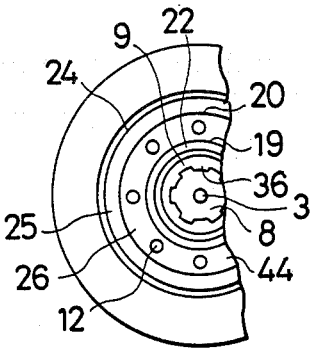
FIG. 2 shows a view in the direction of A of FIG. 1.

FIG. 2 shows a view in the direction of A of FIG. 2. On the central axis of the burner are arranged oil spray nozzle 3, primary air ejection port 8 therearound and flame-retaining plate 9 on the outer periphery thereof. The flame-retaining plate 9 has a projected part 36, that has an inner edge with alternating convex and concave parts to provide the inner edge of the ejection port 8, whereby the combustion rate is improved by induction of the turbulent flow on flame-retaining plate 9 to improve flame-retainability. On the outer periphery of the plate 9 is secondary air ejection port 22; on the outer periphery thereof is a tertiary guide sleeve 25 having a radially extended shape; and further on the outer periphery thereof is provided tertiary air ejection port 24.

Figure 4:
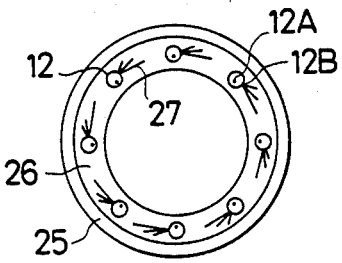
FIG. 4 shows an explanatory view illustrating the ejecting direction of sub-hole gas ejected onto an annular end plate in the partial view in the direction of A of FIG. 1.

FIG. 4 shows a partial view in the direction of A of FIG. 1. In this figure, the arrangement of the annular end plate 26, tertiary guide sleeve 25 and gas nozzles 12 are shown. As to gas nozzles 12, besides the main holes 12A for feeding gas directly into the inside of the furnace which are arranged in the direction somewhat deviated from the central part so as to form a whirling flame, sub-holes 12B are arranged so that the gas ejected from said sub-hole 12B is directed to said annular end plate 26 to generate gas ejection 27 as shown in FIG. 4. Due to this sub-hole gas, it is possible to form a further stabilized flame downstream from the annular end plate 26 and tertiary guide sleeve 25.

According to the above-mentioned embodiment, particularly in the case where coal or oil is burnt, since tertiary air ejection port 24 is arranged so as to be partitioned from secondary air ejection port 22 by the width of the annular end plate 26, it is possible to retain the combustion zone of primary air sufficiently in a high temperature reducing atmosphere. Further, since tertiary air can afford an intense whirling without incurring any flow resistance due to gas nozzle 12, it is possible to contribute to the combustion of unburnt materials flowing outside the combustion flame by primary air and secondary air or downstream therefrom.

Further, since the stabilization of flame is reinforced as a whole, it is possible to reduce the change of furnace pressure and also increase the turndown ratio of burner. Still further, since the flame stability is improved, it is possible to actuate flame detection with certainty.

Figure 3:
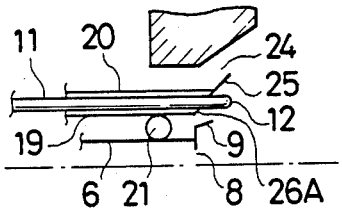
FIG. 3 shows a cross-sectional view illustrating another embodiment of B part of FIG. 1.

FIG. 3 shows a cross-sectional view of another embodiment of the present invention in the B part of FIG. 1. The slant of tertiary guide sleeve 25 is extended in place a perpendicular part of the annular end plate 26 to form a slanted annular end plate 26A. Even in the case of such a constitution, it is possible to achieve the same effectiveness as in the case of FIG. 1.

Figure 5:
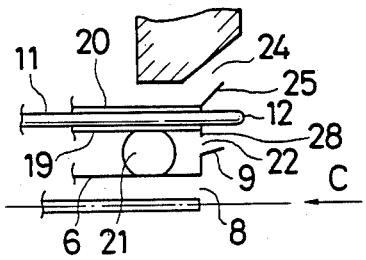
FIG. 5 shows a cross-sectional view illustrating another embodiment of B part of FIG. 1.
Figure 6:
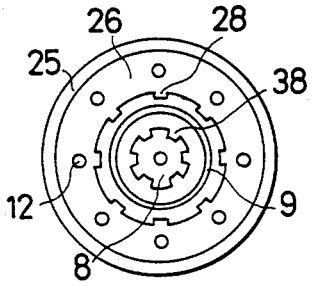
FIG. 6 shows a view in the direction of C of FIG. 5.

FIG. 5 shows another embodiment in the vicinity of the B part of FIG. 1. The different point from the embodiment of FIG. 1 consists in that a projection part 28 having a reduced diameter toward the center of secondary air ejection port 22 is partially or completely provided on the inner peripheral side of annular end plate 26. This projected part 28 may have a similar constitution to that of the inner peripheral part of flame-retaining plate 9, as shown in FIG. 6 which is a view in the direction of C of FIG. 5. By providing such projected part 28, it is possible to further enforce the gas flame stability on annular end plate 26.

Figure 7:
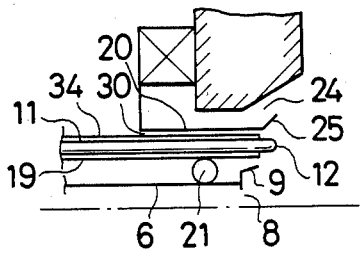
FIG. 7 shows a cross-sectional view illustrating another embodiment of B part of FIG. 1.

FIG. 7 shows a cross-sectional view illustrating another embodiment of B part of FIG. 1. In this embodiment, secondary air feeding pipe 20 and secondary outer sleeve 34 are separated so that an annular gap 30 for passing a cooling air is provided therebetween, whereby the tertiary guide sleeve 25 is cooled effectively, molten ash particles are prevented from entering into the guide sleeve 25 or are accelerated to solidify by the cooling air to prevent a scale or clinker from forming on the guide sleeve 25.

In the case where the tertiary guide sleeve 25 is provided at the perpendicular annular end plate 26 as shown in FIG. 1, the difference A between the outer diameter of the tertiary guide sleeve 25 and the average hydraulic diameter of the annular space part 44 is preferable to be not less than 30% of the difference B between the inner diameter of the annular space part 44; $A \geqq 0.30 \times B$.

In the case where the tertiary guide sleeve 25 is arranged extending from annular end plate 26A as shown in FIG. 3, the difference A between the outer diameter of the tertiary guide sleeve 25 and the average hydraulic diameter of the annular space part 44 is preferable to be not less than 40% of the difference B between the inner diameter of the burner throat 40 and the average hydraulic diameter of the annular space part 44; $A \geqq 0.40 \times B$.

By the above arrangement of the tertiary guide sleeve 25 and the annular space part 44, the secondary air passageway and the tertiary air passageway are separated more clearly and the flame stability is improved.

As fuel to be fed to the pulverized coal-feeding pipe, fine solid fuel like petroleum cokes may be used instead of coal.

According to the present invention, it is possible to burn two kinds or more of fuels such as gas, oil, coal, etc. employing the same apparatus together. Thus, it is possible to optionally burn economical fuels employing the same combustion apparatus without employing two or more sets of combustion apparatuses or modifining burners. Further, according to the present invention, it is possible to realize combustion for low concentration NOx with any fuel(s), whereby it is possible to reduce the dependency of combustion apparatus on exhaust gas denitration process by the use of denitration catalyst, and also to reduce the amount of ammonia consumed therein.

What we claim is:

1. An apparatus for low concentration NOx combustion which comprises:
- a pulverized coal-feeding pipe (pulverized coal pipe) inserted into a burner throat on the lateral wall of a combustion furnace and for feeding pulverized coal together with air into the combustion furnace;
- a means for feeding pulverized coal and air into the pulverized coal pipe;
- an auxiliary fuel-feeding pipe inserted into the pulverized coal pipe and a nozzle provided at the tip end of said pipe;
- a secondary air passageway formed between the pulverized coal pipe and a secondary air-feeding pipe, said secondary air-feeding pipe being concentric with the pulverized coal pipe and provided on the outer peripheral side of the pulverized coal pipe;
- a tertiary air passageway formed on the outer peripheral side of the secondary air-feeding pipe;
- a means for feeding air or an oxygen-containing gas into said secondary air passageway and that into said tertiary air passageway;
- a flame-retaining means provided about the exit of said pulverized coal pipe;
- a means for feeding oil or gas into the auxiliary fuel-feeding pipe;
- an annular space part provided on the inner peripherical side of the secondary air-feeding pipe;
- gas-feeding pipes inserted in said annular space part in a movable manner in the axial direction thereof, the tip end of the gas-feeding pipe being provided with a gas nozzle;
- a means for feeding gas into said gas-feeding pipe.

2. An apparatus for low concentration NOx combustion according to claim 1, wherein said annular space is surrounded by a secondary inner sleeve, a secondary outer sleeve and annular end plates provided at the both ends of said sleeves to form said annular space part, said annular end plates having a plurality of holes through which said gas-feeding pipes are penetrated.

3. An apparatus for low concentration NOx combustion according to claim 2, wherein said outer secondary sleeve is common with and constituted of a part of said secondary air-feeding pipe.

4. An apparatus for low concentration NOx combustion according to claim 1, wherein a guide sleeve is provided at the tip end of said secondary air-feeding pipe.

5. An apparatus for low concentration NOx combustion according to claim 1, wherein said gas nozzle is provided with a sub-hole besides main ejecting hole of said gas nozzle, which sub-hole is arranged so that gas ejected from said sub-hole can be fed to said annular plate.

6. An apparatus for low concentration NOx combustion according to claim 1, wherein said flame-retaining means is a plate having a L-letter form cross-section provided at the tip end of said pulverized coal pipe and encircling said pipe.

7. An apparatus for low concentration NOx combustion according to claim 6, wherein said frame retaining plate provided at the tip end of said pulverized coal pipe has a projected part toward the center of said pulverized coal pipe, the inner diameter of said projected part being smaller than that of said pulverized coal pipe.

8. An apparatus for low concentration NOx combustion according to claim 7, wherein the inner edge of said projected part is of convex and concave shape.

9. An apparatus for low concentration NOx combustion according to claim 1, wherein an annular plate having a projected part toward the center of said secondary air-feeding pipe is provided at the tip end of said secondary air-feeding pipe, the inner diameter of said projected part being smaller than that of said secondary air-feeding pipe.

10. An apparatus for low concentration NOx combustion according to claim 9, wherein the inner edge of said projected part is of convex and concave shape.

11. An apparatus for low concentration NOx combustion according to claim 2, wherein a guide sleeve is provided at the tip end of said secondary outer sleeve and the other end thereof in extended to form said annular end plate.

12. An apparatus for low concentration NOx combustion according to claim 2, wherein one or a plurality of holes for introducing a portion of said secondary air is provided on said secondary outer sleeve or said secondary inner sleeve.

13. An apparatus for low concentration NOx combustion according to claim 2, wherein an annular gap for passing a portion of said secondary air is provided between said secondary outer sleeve and said secondary air-feeding pipe.

* * * * *